United States Patent [19]

Kobayashi et al.

[11] Patent Number: 4,938,661

[45] Date of Patent: Jul. 3, 1990

[54] MULTISTAGE CENTRIFUGAL COMPRESSOR

[75] Inventors: Hiromi Kobayashi; Hideo Nishida; Haruo Miura, all of Ibaraki, Japan

[73] Assignee: Hitachi, Ltd., Tokyo, Japan

[21] Appl. No.: 404,597

[22] Filed: Sep. 8, 1989

[30] Foreign Application Priority Data

Sep. 14, 1988 [JP] Japan ..... 63-228745

[51] Int. Cl.[5] ..... F01D 07/00; F03D 03/06

[52] U.S. Cl. ..... 415/199.1; 415/199.2; 415/199.3; 415/208.1

[58] Field of Search ..... 415/199.1, 199.2, 199.3, 415/199.6, 208.1, 208.2, 208.3, 211.1, 211.2; 416/201 R, 201 A

[56] References Cited

U.S. PATENT DOCUMENTS

| | | | |
|---|---|---|---|
| 1,580,878 | 4/1926 | Dufour | 415/199.3 |
| 2,224,010 | 9/1980 | Fujino | 415/199.2 |
| 2,995,293 | 8/1961 | Buchi | 415/199.2 |
| 3,105,632 | 10/1963 | Tanzberger | 415/199.1 |
| 3,927,763 | 12/1975 | Strub et al. | 415/199.2 |
| 4,715,778 | 12/1987 | Katyyama et al. | 415/199.1 |

FOREIGN PATENT DOCUMENTS

| | | | |
|---|---|---|---|
| 0098692 | 7/1980 | Japan | 415/199.1 |
| 522343 | 9/1976 | U.S.S.R. | 415/211 |

*Primary Examiner*—Robert E. Garrett
*Assistant Examiner*—Hoang Nguyen
*Attorney, Agent, or Firm*—Antonelli, Terry, Stout & Kraus

[57] ABSTRACT

A multistage centrifugal compressor has a shaft rotatable on an axis and a plurality of centrifugal impellers fixed on the shaft and having outlets at outer peripheries thereof. Conduits connect the impellers to from a path for fluid undergoing multi-stage compression by the impellers from a suction side to a delivery side. The conduits including a plurality of diffusers arranged radially outwardly from the impellers, each impeller and associated diffuser constituting a stage. At least two of the diffusers are vaned diffusers provided with vanes having leading edges at their inlet ends. To provide high efficiency combined with low risk of rotating stalls, among the vaned diffusers, the ratio of diffuser vane leading edge radius to impeller outlet radius increases along the fluid path from the delivery of the compressor to the suction side.

18 Claims, 5 Drawing Sheets

MULTISTAGE CENTRIFUGAL COMPRESSOR

BACKGROUND OF THE INVENTION

1. Field of the Invention

The present invention relates to a single axis multistage centrifugal compressor including diffusers provided radially outwardly from impellers of the compressor.

Multistage centrifugal compressors are of a high-pressure type and, typically, have an operating outlet pressure of at least 50 atmospheres, with such compressors being used for compressing gases, for example, the chemical industry for injecting gases, in oil fields for air compression and in gas pipe lines.

2. Description of the Prior Art

High-pressure high-speed multistage centrifugal compressors have been proposed wherein a plurality of centrifugal compressor stages are arranged at one rotational axis, with the centrifugal compressor utilizing vaneless diffusers; whereas, in low-pressure compressors vaned diffusers are widely used both in the single stage and multistage compressors. In these compressors, the ratio r/R of an outlet radius of impeller R to the diffuser vane leading edge radius r is constant at all stages. Multistage centrifugal compressors of the aforementioned type are described in, for example, "Blower and Compressor", Takefumi Ikui, Asakura Shoten, June 25, 1974.

Diffusers with vanes have not been adopted for high-pressure compressors, because a multistage centrifugal compressor having vaned diffusers has a high maximum efficiency but a narrow operating range. As fluid is compressed in the multistage centrifugal compressor, the passage width becomes smaller toward the delivery side of the compressor since its volume flow rate becomes smaller. As a result, the specific speed of an impeller at rear stages is smaller than that of an impeller at front stages. Thus, the pressure is higher and the specific speed is smaller at a rear stage in a multistage centrifugal compressor, and the phenomenon called "rotating stalls" often occurs at the rear stage side of compressor.

A rotating stall in a vaneless diffuser is generated when the flow is reduced in a certain compressor stage and the average flow angle $\alpha$ at a diffuser inlet of the stage becomes less than the prescribed value. Under these conditions, because of the rise of static pressure in the radial direction, reverse flow initiates locally at the boundary layers in the diffuser passage and develops into the main flow. The stall area rotates around the axis at low frequency.

If such a rotating stall occurs, pressure fluctuation caused by the stall becomes a strong shaft exciting force, as the pressure of the fluid increases. Accordingly, shaft vibration becomes large in a compressor with a high pressure level and driving the compressor becomes difficult, which limits the operating range of the compressor.

For example, if a rotating stall occurs at point C in a vaneless diffuser stage as shown in the graph of FIG. 8, the stable driving range (SDR) is at a larger flow rate than Qc. This means that the operating range becomes narrow compared with the case where a rotating stall is assumed not to occur, in which stable operation is possible at a flow rate greater than Qa.

This problem of vibrations in very high pressure centrifugal compressors was discussed by Ferrara in American Society of Mechanical Engineering (ASME) publication 77-DET-15 of 1977, and attributed to rotating stalls.

Turusaki in the Japanese magazine "Turbomachine" Vol. 12, 1984, No. 6, pages 323–332, describes rotating stalls in more detail, and Nishida et. al. in Reports of the Japanese Society of Mechanical Engineering, March 1988, pages 589–594 discuss the conditions for rotating stalls in vaneless diffusers.

As a countermeasure against rotating stalls in a vaneless diffuser, it has been usual to reduce the axial passage height of the diffuser from h to h' as shown in FIGS. 9 and 10 to delay the onset of a rotating stall. The ratio of the diffuser passage height to the outlet height b of the impeller is reduced and the radial velocity is increased from Cm to Cm'. The flow angle $\alpha'$ at the diffuser inlet is thus larger compared with the flow angle $\alpha$ when the diffuser passage height is larger. Accordingly, it is possible to widen the stable driving range as graphically shown in FIG. 11 by enlarging the inlet flow angle for the same flow rate to delay the onset of a rotating stall. Thus, reducing the passage height has the effect of moving the rotating stall onset point towards the surge point. Rotating stalls can be prevented if the diffuser passage height is decreased greatly compared with the impeller outlet height. However, it is necessary drastically to lower the diffuser passage height completely to prevent rotating stalls, and as the average fluid velocity becomes large in addition to the reduction in passage height by this method, friction loss in the diffuser is increased and performance becomes lower.

SUMMARY OF THE INVENTION

The object of the present invention is to prevent generation of rotating stalls in the diffusers of a high pressure multistage centrifugal compressor, and thus provide a compressor which can be driven stably with high efficiency over a wide operating range.

The invention adopts vaned diffusers and, in with respect of to at least two stages, increases the ratio r/R of the outlet radius R of the centrifugal impellers to the diffuser vane leading edge radius r from the rear stage side (delivery side) toward the front stage side (suction side). In another aspect, in at least two stages, the ratio r/R and h/R, where h is the axial passage height of the diffuser (vane axial height), are selected so as to satisfy the following relationships $$h/R \leqq 0.04 \text{ and}$$

$$r/R \leqq 1+3.3\ h/R.$$

When vanes are provided in accordance with these principles, the flow is forcibly directed by the vane towards the radial direction, and there is hardly any reverse flow. That is to say, the diffuser with vanes has the effect of preventing reverse flow by providing a vane front edge at the inner side of the position where reverse flow is generated first in case of a vaneless configuration.

According to the invention in one aspect, therefore, there is provided a multi-stage centrifugal compressor having a shaft rotatable on an axis, a plurality of centrifugal impellers fixed on said shaft and having outlets at their peripheries, and conduits connecting the impellers to form a path for fluid undergoing multi-stage compression by the impellers from a suction side to a delivery side of the compressor. The conduits include a plurality of diffusers arranged radially outwardly from the impellers, with each impeller and associated diffuser constituting a stage. At least two of the diffusers are in the form of vaned diffusers. Among the vaned diffusers, a first one has a ratio of diffuser vane leading edge radius to impeller outlet radius larger than the same ratio of a second one which is closer along the path to the delivery side than the first one.

Usually, there are at least four centrifugal impellers and at least four vaned diffusers. The ratio of diffuser vane leading edge radius to impeller outlet radius preferably increases from each of the vaned diffusers to the next one along the fluid compression path in the direction from the delivery side to the suction side.

In the high pressure compressor of the invention, in at least one stage, and more preferably, in all stages having vaned diffusers, the ratio of the axial height of the vanes to the impeller outlet radius is less than 0.04, and may be less than 0.03.

To increase efficiency, preferably in each stage having a vaned diffuser, the following relationship exists:

$$r/R \leqq 1+3.3\ h/R,$$

wherein:

h=an axial height of the vanes,

R=an impeller outlet radius, and r=a diffuser vane leading edge radius.

In addition to the stages having vaned diffusers, there may be at least one stage having a vaneless diffuser, closer to the suction side than the vaned diffusers.

The compressor of the invention typically has a design operating delivery pressure of at least 50 atmospheres, and, in many cases, at least 100 atmospheres.

In each stage having a vaned diffuser, preferably, the ratio of the outlet radius of the vanes to the inlet radius of the vanes is not more than 1.2, and the maximum thickness of each vane is, preferably, in the range 5 to 12% of the chord length of the vane. Typically in each stage having a vaned diffuser, the number of vanes is in the range 10 to 30, and preferably, 12 to 20.

Normally, the vanes extend the full axial height of the diffuser.

In another aspect, the invention provides a multistage centrifugal compressor having a shaft rotatable on an axis, a plurality of centrifugal impellers fixed on the shaft and having outlets at their peripheries, and conduits connecting the impellers to form a path for fluid undergoing multi-stage compression by the impellers from a suction side to a delivery side of the compressor. The conduits include a plurality of diffusers arranged radially outwardly from the impellers with each impeller and associated diffuser constituting a stage. At least two of the diffusers are vaned diffusers. And respect each vaned diffuser and its associated impeller the following relationships exist:

$$h/R \leqq 0.04 \text{ and}$$

$$r/R \leqq 1+3.3\ h/R,$$

wherein:

h=an axial height of the vanes,

R=an impeller outlet radius, and r=a diffuser vane leading edge radius.

BRIEF DESCRIPTION OF THE DRAWINGS

Embodiments of the present invention are given below by way of non-limitative example with reference to the accompanying drawings, wherein.

DESCRIPTION OF THE PREFERRED EMBODIMENTS

Figure 1:
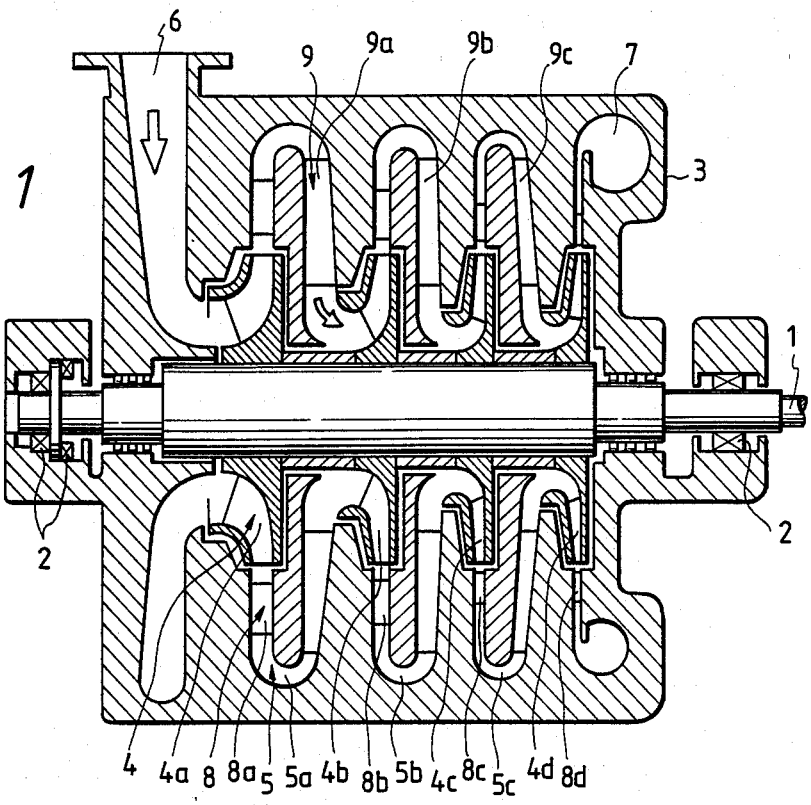
FIG. 1 is an axial section of a multistage centrifugal compressor embodying the present invention.
Figure 2:
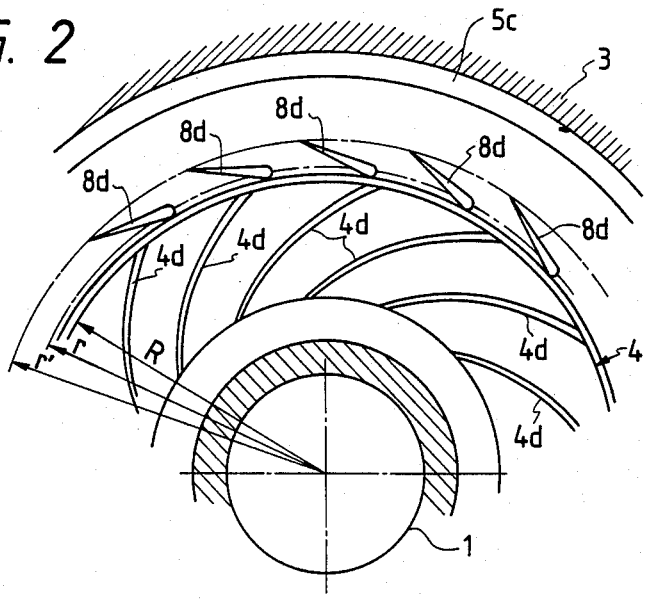
FIG. 2 is a typical radial section of a stage of the compressor of FIG. 1.
Figure 3:
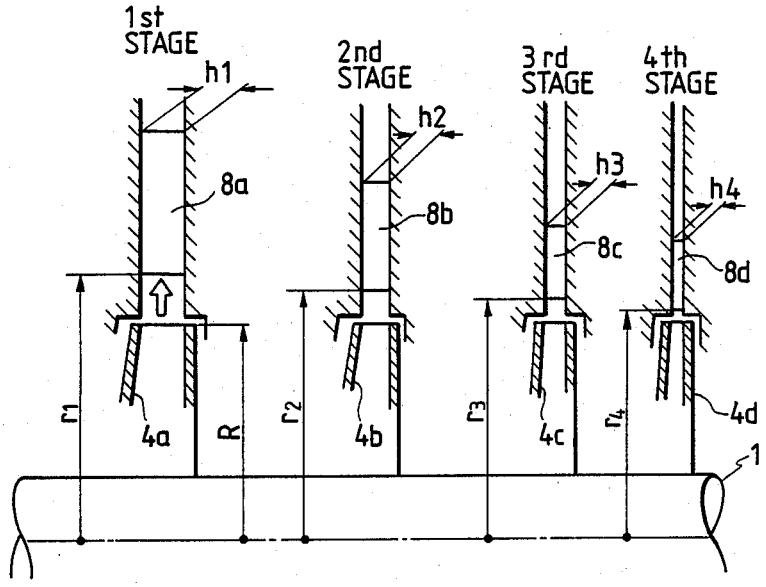
FIG. 3 is a diagrammatic view of impellers and vaned diffusers in the compressor embodying the invention.

Referring now to the drawings wherein like reference numerals are used through out the various views to designate like parts and, more particularly, to FIGS. 1–3, according to these figures, a high-pressure multistage centrifugal compressor includes a rotating shaft 1, installed in a casing 3 on bearings 2, with centrifugal impellers generally designated by the reference numeral 4 respectively defining a first stage **4*a*, second stage 4*b*, third stage 4*c*, and fourth stage 4*d*. The impellers 4 are carried by the shaft 1, and an outlet radius R of the respective impellers 4 is the same in all four stages 4*a*–4*d***, and an axial height h of the diffuser passage is decreased according to a change of volume flow rate.

The outlet and inlet of each adjacent pair of impellers 4 in the sequence are connected by passages 5 respectively defining a first stage **5*a*, second stage 5*b*, third stage 5*c*, formed in the casing 3. The inlet of the centrifugal impeller 4 of the front stage 4*a* (suction side) is connected to an inlet port 6 of the casing 3 and the outlet of centrifugal impeller 4 at the rear stage 4*d* (delivery side) is connected to an outlet port 7 of the casing 3. Vaned diffusers 8 respectively defining a first stage 8*a*, second stage 8*b*, third stage 8*c* and fourth stage 8*d* are provided in the passage at the outlet side of each impeller stage 4*a*, 4*b*, 4*c* and 4*d*, and return channels 9 respectively defining a first stage 9*a*, second stage 9*b* and third stage 9*c* are arranged at the inlet side of each impeller stage 4*b*, 4*c* and 4*d***.

Figure 4:
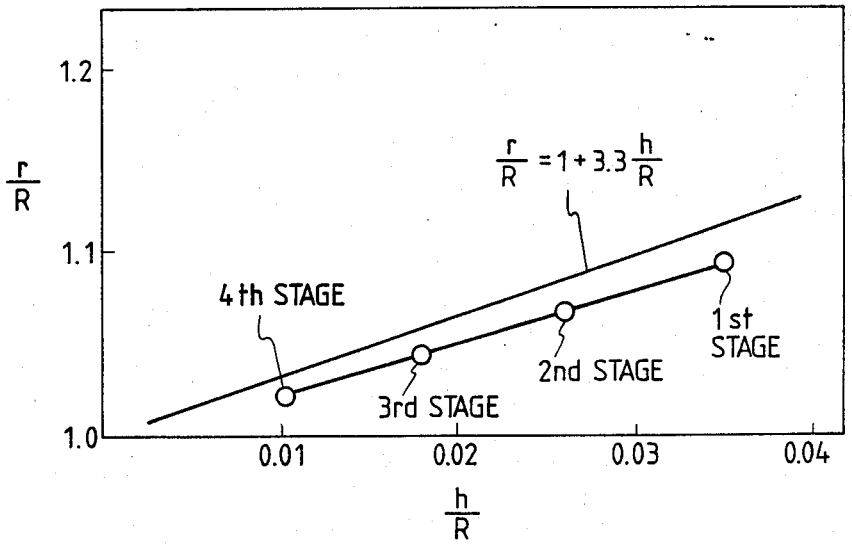
FIG. 4 is a graph relating certain dimensions of the compressor of FIGS. 1 to 3.

FIGS. 3 and 4 indicate relative values of the outlet radius R of the impellers 4, the height h of the vaned diffusers 8 and the leading edge radius r of the diffuser vanes, with these values satisfying the following relationship:

$$r/R < 1+3.3\ h/R. \quad (1)$$

In this case, the radius at the rear edge of the diffuser vanes is not explicitly specified.

The effect of this embodiment will now be described.

In such a multistage centrifugal compressor, the fluid is compressed as it flows toward the rear stage **4*d*, volume flow rate is decreased, and, consequently, the passage height h of the diffuser 8 becomes generally smaller, but the smaller the passage height h, the more reverse flow is generated at the inner diameter region of the diffuser 8**. The relation between this passage height h and the reverse flow onset radius r1 is approximated by the following relationship $$r1/R \approx 1+3.3\ h/R. \quad (2)$$

In other words, the position of the radius where the reverse flow occurs first, for a given passage height h is determinable by equation (2).

As explained above, a rotating stall is generated in the diffuser 8 when this reverse flow develops and forms a stall zone which rotates in the diffuser. Accordingly, if the first reverse flow is restrained in the diffuser 8, rotating stalls can be prevented.

In vaned diffusers, if the vane front edge radius r becomes small, the noise and strength of the vane are adversely affected since high speed fluid coming out of the centrifugal impeller 4 collides with the vane. As the inlet radius r of the vanes increases towards the front stage **4*a* (suction side) in the range satisfying the above relation (1) it is more beneficial in terms of noise and strength of the vane, compared with the case where the ratio r/R is fixed at a small value and is constant for all stages 4*a*–4*d***.

Moreover, the vaned diffusers 8 prevent rotating stalls without the reduction of the passage height h required for the vaneless diffusers, and the passage length passing through the diffusers 8 is also shortened and friction loss is small. Therefore, a high level of efficiency can be obtained since the flow is forcibly directed by the vanes and flow angle is large.

Consequently, rotating stalls can be prevented in all stages **4*a*–4*d*** and a multistage centrifugal compressor that achieves high efficiency and can be operated stably over a wide range is obtained.

Figure 5:
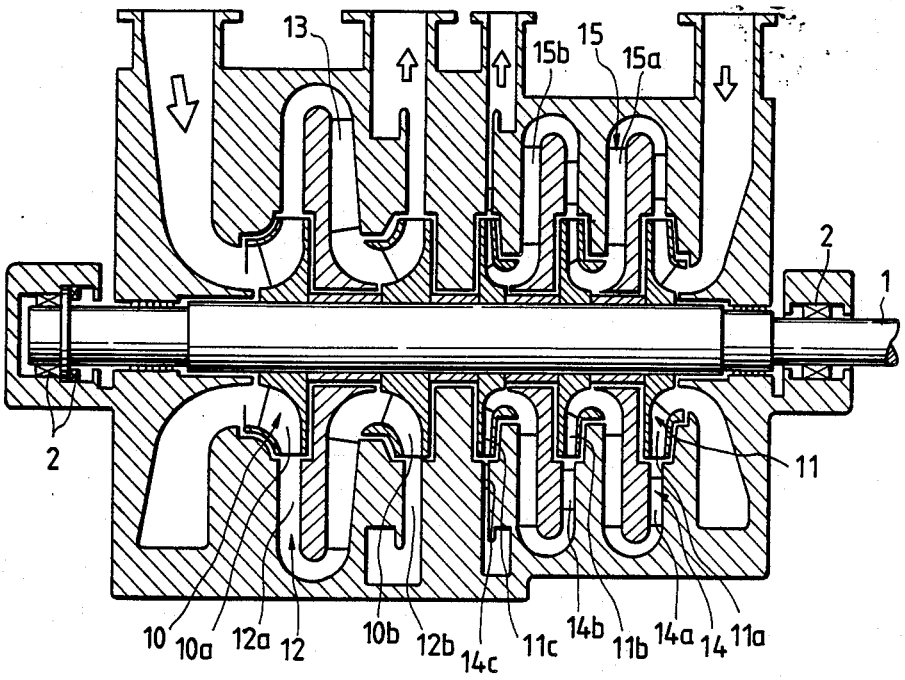
FIG. 5 is an axial section of another embodiment of the invention.
Figure 6:
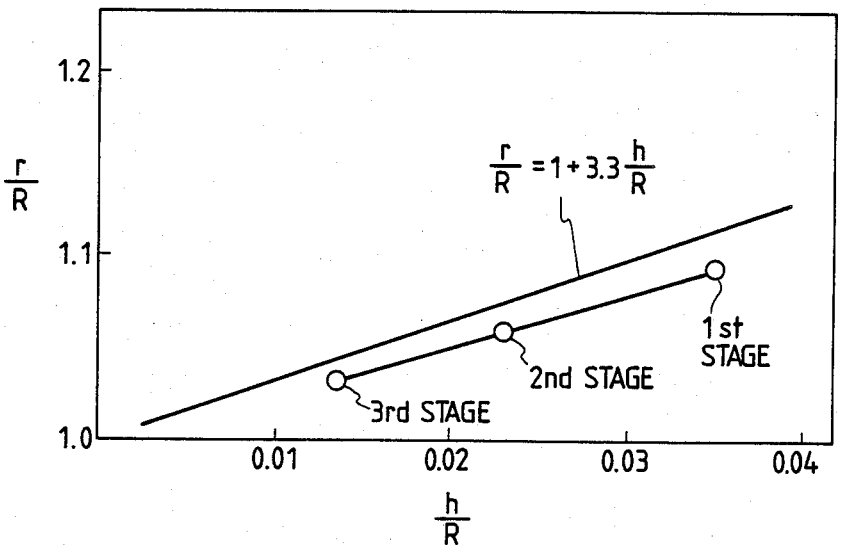
FIG. 6 is a graph similar to that of FIG. 4 for the embodiment of FIG. 5.

The embodiment of FIGS. 5 and 6 is a multistage centrifugal compressor with five stages in which intercooling of the fluid is carried out between the low pressure stage side and the high pressure stage side.

Centrifugal impellers 11 respectively define a first stage **11*a*, second stage 11*b*, and third stage 11*c* of the high-pressure stage side group with the same outlet radius R, and centrifugal impellers 10 respectively define a first stage 10*a* and a second stage 10*b* of the low-pressure stage side group with the same outlet radius R, with the impellers 10, 11 being fixed on the rotational shaft 1. The low-pressure stage side group has vaneless diffusers 12 respectively defining a first stage 12*a* and a second stage 12*b*, and a return channel 13, and the high-pressure stage side group has vaned diffusers 14 respectively defining a first stage 14*a*, second stage 14*b*, and third stage 14*c* and return channels 15 respectively defining a first stage 15*a* and a second stage 15*b***. The reason vaneless diffusers are used for the low-pressure stage side group and vaned diffusers for the high-pressure side group is as follows.

The impellers 10, 11 of this multistage centrifugal compressor have a wide range of specific speeds. Since at the low pressure stage side (front stage side) the specific speed is large and the flow angle of the diffusers is large for design convenience, rotating stalls hardly occur. At the low pressure level, even if a rotating stall is generated, its small shaft exciting force does not cause a problem.

In the embodiment of FIGS. 5 and 6, vaned diffusers 14 are provided for the high pressure stage group where rotating stalls cause a problem, and the leading edge radius ratio of each diffuser is set in accordance with the relationship graphically illustrated in FIG. 6.

Therefore, in the embodiment of FIGS. 5 and 6, rotating stalls in the diffusers can be prevented in the three stages on the rear stage side, and the compressor properties of high efficiency and a wide stable driving range can be obtained.

Figure 7:
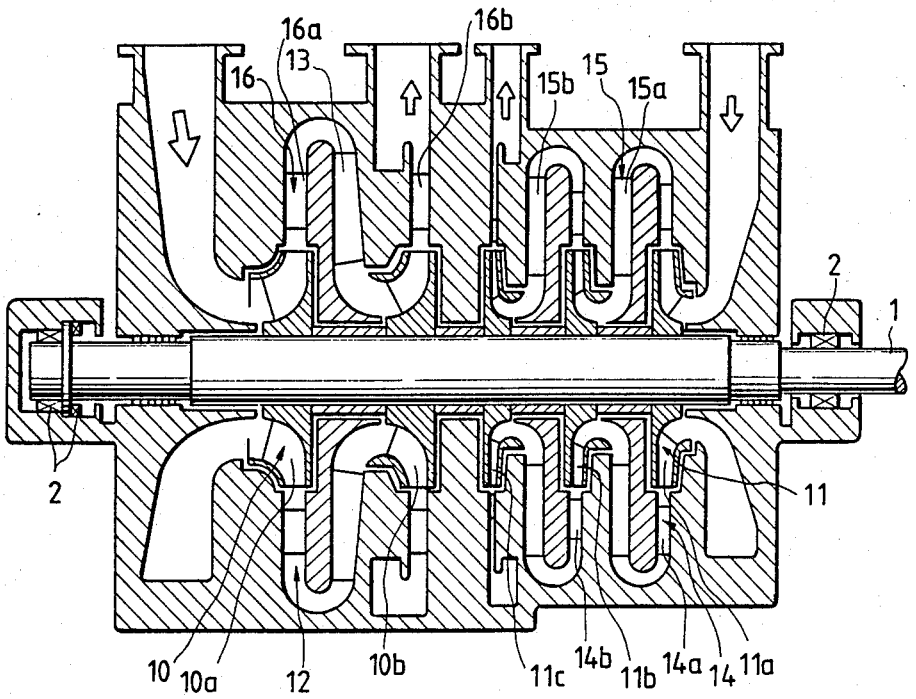
FIG. 7 is an axial section of yet another compressor embodying the invention.
Figure 8:
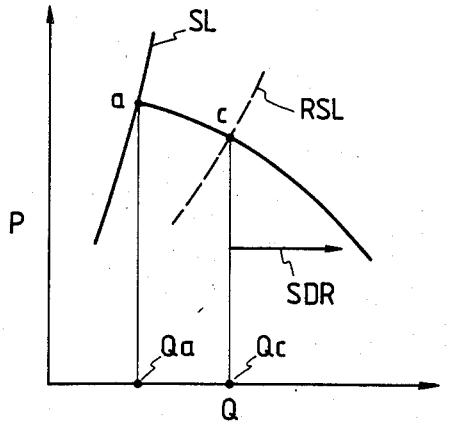
FIG. 8 (PRIOR ART)
FIGS. 8 to 11 are diagrams explaining the properties of a conventional multistage centrifugal compressor.
Figure 9:
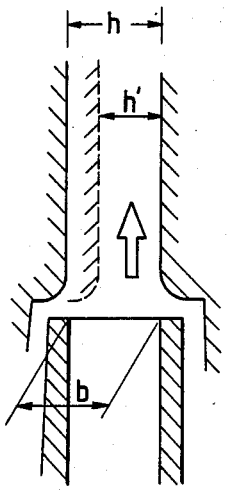
FIG. 9 (PRIOR ART)
Figure 10:
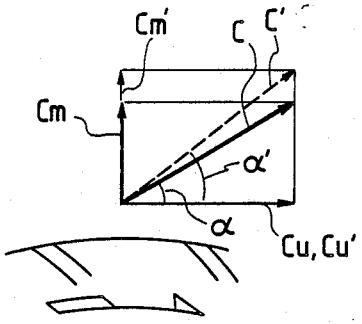
FIG. 10 (PRIOR ART)
Figure 11:
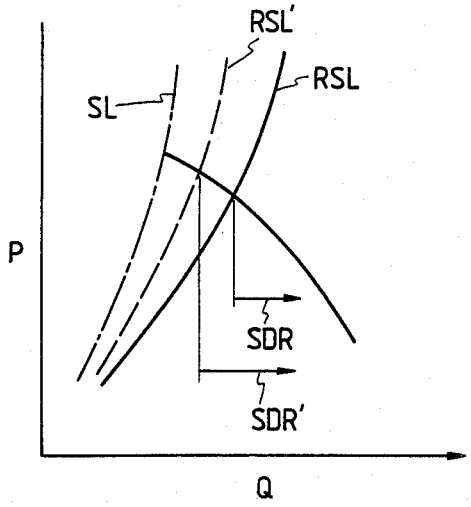
FIG. 11 (PRIOR ART)

The embodiment of FIG. 7 differs from the embodiment of FIGS. 5 and 6 in that vaned diffusers 16 are used at the low pressure stage side group. The ratio r/R of the leading edge radius r of these diffuser vanes 16 to the centrifugal impeller outlet radius R is constant. Vaned diffusers are used in the high pressure stage side group and the ratio r/R of the leading edge radius r of the diffuser vanes 14 defining the first stage **14*a* and second stage 14*b*** to the impeller outlet radius R satisfy the relationship with the ratio h/R of the diffuser vane height h to the impeller outlet radius R as follows:

$$r/R < 1+3.3\ h/R,$$

and the ratio r/R increases from the rear stage side to the front stage side in this group.

In the embodiment of FIG. 7, using the vaned diffusers with the constant ratio r/R for the low pressure stage side group and giving it high efficiency, the compressor can be driven very efficiently.

Moreover, highly efficient operation is achieved in this compressor by making the ratio r/R of the diffuser leading edge radius of the low pressure stage side group and the impeller outlet radius R constant and setting this ratio r/R to satisfy the relationship with the ratio h/R of the diffuser vane height h to the impeller outlet radius R:

$$r/R < 1+3.3\ h/R.$$

In the above describe embodiments, if the flow through the impellers is increased more than the flow through each stage by increasing the leakage flow between the inlets and the outlets of the centrifugal impellers, and it is arranged that the impellers work only at the large flow side, more effective prevention of rotating stalls is achieved.

Dimensions and design operating conditions of two multistage compressors of the invention are given in Tables 1 and 2 below. The compressors are generally as shown in FIG. 1; the compressor of Table 1 has four stages, whereas, the compressor of Table 2 has three stages.

TABLE 1

| | 1st stage | 2nd stage | 3rd stage | 4th stage |
|---|---|---|---|---|
| Impeller outlet radius R | 85 mm | 85 mm | 75 mm | 75 mm |
| Vane leading edge radius r | 93.5 mm | 91.8 mm | 78.5 mm | 77.5 mm |
| Vane trailing edge radius r' | 107.5 mm | 105.5 mm | 90.3 mm | 98 mm |
| Number of vanes | 18 | 18 | 18 | 18 |
| Vane height in axial direction h | 3.0 mm | 2.6 mm | 2.0 mm | 1.8 mm |
| Radius ratio r/R | 1.1 | 1.08 | 1.047 | 1.033 |
| Height ratio h/R | 0.035 | 0.031 | 0.027 | 0.024 |
| Shaft rotational speed: 14370 rpm | | | | |
| GAS: $CO_2$ | | | | |
| Pressure Suction/Delivery: 45/140 atmospheres | | | | |

TABLE 2

| | 1st stage | 2nd stage | 3rd stage |
|---|---|---|---|
| Impeller outlet radius R | 145 mm | 145 mm | 145 mm |
| Vane leading edge radius r | 155.2 | 152.3 | 149.4 |
| Vane trailing edge radius r' | 178.4 | 175.1 | 171.8 |
| Number of vanes | 16 | 16 | 16 |
| Vane height in axial direction h | 3.7 mm | 3.3 mm | 3.0 mm |
| Radius ratio r/R | 1.07 | 1.05 | 1.03 |
| Height ratio h/R | 0.026 | 0.023 | 0.021 |
| Shaft rotational speed: 11600 rpm | | | |
| Gas: Ethylene | | | |
| Pressure Suction/Delivery: 65/122 atmospheres | | | |

What is claimed is:

1. A multistage centrifugal compressor comprising a shaft rotatably on an axis, a plurality of centrifugal impeller means fixed on said shaft each having an outlet at a periphery thereof, conduit means for connecting said impeller means to form a fluid compression path for fluid undergoing multi-stage compression by said impeller means from a suction side to a delivery side of the compressor, said conduit means including a plurality of diffuser means arranged radially outwardly from impeller means, each impeller means and associated diffuser means constituting a stage of the centrifugal compressor, said diffuser means including at least two vaned diffusers provided with vanes having leading edges at inlet ends thereof a first one of said at least two vaned diffusers has a ratio of diffuser vane leading edge radius to impeller outlet radius larger than a ratio of diffuser vane leading radius to impeller outlet radius ratio of a second of said at least two vaned diffusers, and wherein the second of said at least two vaned diffusers is closer along said fluid compression path to the delivery side of the compressor than said first one of said at least two vaned diffusers.

2. A compressor according to claim 1, wherein at least four centrifugal impeller means and at least four vaned diffusers are provided, and wherein said ratio of diffuser vane leading edge radius to impeller outlet radius increases from each of said vaned diffusers to the next vaned diffuser along the fluid compression path in the direction from the delivery side of the compressor to the suction side of the compressor.

3. A compressor according to claim 1, wherein in at least one stage a ratio of an axial height of the vanes of the vaned diffuser to the impeller outlet radius is less than 0.04.

4. A compressor according to claim 3, wherein the ratio of the axial height of the vanes of the vaned diffuser to the impeller outlet radius is less than 0.04 in each stage having a vaned diffuser.

5. A compressor according to claim 1, wherein the ratio of diffuser vane leading edge radius to impeller outlet radius in each stage having a vaned diffuser is determined in accordance with the following relationship:

$$r/R \leqq 1+3.3\ h/R,$$

wherein:

h=an axial height of the vanes,

R=impeller outlet radius, and r=diffuser vane leading edge radius.

6. A compressor according to claim 1, wherein in at least one stage a ratio of an axial height of the vanes to the impeller outlet radius is less than 0.03, and wherein in each stage having a vaned diffuser the ratio of diffuser vane leading edge radius to the impeller outlet radius is determined in accordance with the following relationship:

$$r/R \leqq 1+3.3\ h/R$$

wherein:

h=the axial height of the vanes,

R=the impeller outlet radius, and r=the diffuser vane leading edge radius.

7. A compressor according to claim 1, wherein said diffuser means further includes a vaneless diffuser provided in at least one stage of the centrifugal compressor at a position closer to the suction side of the compressor than the at least two vaned diffusers.

8. A compressor according to claim 1, wherein the compressor has an operating delivery pressure of at least 50 atmospheres.

9. A compressor according to claim 1, wherein a ratio of the outlet radius of the vanes of the vaned diffuser to an inlet radius of the vanes in not more than 1.2.

10. A compressor according to claim 1, a maximum thickness of each of the vaned diffuser is in a range of 5–12% of a chord length of the vane.

11. A compressor according to claim 1, wherein the number of vanes in a range of 10 to 30.

12. A multi-stage centrifugal compressor comprising a plurality of centrifugal impeller means fixed on a rotary shaft to provide a plurality of compression stages and a diffuser means at each of said stages with at least two of said diffuser means being vaned diffusers, and wherein at least at one of adjacent pairs of stages having vaned diffusers, a ratio of a vane of the vaned diffusers leading edge radius to an outlet radius of the impeller means is larger at a stage of said adjacent pairs which is closer to the a suction side of the compressor.

13. A multi-stage centrifugal compressor having a shaft rotatable on an axis, a plurality of centrifugal impeller means fixed on said shaft and having outlets at outer peripheries thereof, conduit means for connecting said impeller means to form a path for fluid undergoing multi-stage compression by said impeller means from a suction side to a delivery side of the compressor, said conduit means including a plurality of diffuser means arranged radially outwardly from the impeller means, each of said impeller means and associated diffuser means constituting a stage of the compressor, said diffuser means including at least two vaned diffusers provided with vanes having leading edges at inlet ends thereof, and wherein each of said vaned diffusers and associated impeller means have the following relationships:

$$h/R \leqq 0.04, \text{ and}$$

$$r/R \leqq 1+3.3\ h/R,$$

wherein:

h=an axial height of the vanes,

R=an impeller means outlet radius, and r=a diffuser vane leading edge radius.

14. A compressor according to claim 13, wherein said diffuser means further includes a vaneless diffuser provided in at least one stage of the centrifugal compressor at a position closer to the delivery side of the compressor than the at least two vaned diffusers.

15. A compressor according to claim 13, wherein the compressor has an operating delivery pressure of at least 50 atmospheres.

16. A compressor according to claim 13, wherein a ratio of the outlet radius of the vanes of the vaned diffusers to an inlet radius of the vanes is not more than 1.2.

17. A compressor according to claim 13, wherein a maximum thickness of each vane of the vaned diffuser is in a range of 5 to 12% of a chord length of the vane.

18. A compressor according to claim 13, wherein the number of vanes in a range of 10 to 30.

* * * * *